United States Patent [19]

McSorley

[11] Patent Number: 4,724,791

[45] Date of Patent: Feb. 16, 1988

[54] MARINE POWER CORD STOWAGE DEVICE

[76] Inventor: John P. McSorley, 8 Seminary Rd., Bedford, N.Y. 10506

[21] Appl. No.: 930,877

[22] Filed: Nov. 14, 1986

[51] Int. Cl.[4] ..... B63B 17/00

[52] U.S. Cl. ..... 114/343; 114/364; 383/7; 383/97; 190/903; 224/253

[58] Field of Search ..... 114/343, 361, 364; 383/7, 22, 97; 190/903; 224/253, 235, 236, 240; 248/51, 52, 95, 205.1

[56] References Cited

U.S. PATENT DOCUMENTS

| | | | |
|---|---|---|---|
| 136,593 | 11/1943 | Phelps . | |
| 1,205,225 | 11/1916 | Laughlin . | |
| 1,977,774 | 10/1934 | Osborne . | |
| 2,266,334 | 12/1941 | Rice | 224/236 X |
| 2,763,707 | 9/1956 | Soderberg . | |
| 3,187,090 | 6/1965 | Edwards . | |
| 4,004,625 | 1/1977 | Zietlow, Jr. . | |
| 4,026,230 | 5/1977 | Wilford . | |
| 4,037,720 | 7/1977 | McGurk . | |
| 4,240,480 | 12/1980 | Strobel | 383/22 X |
| 4,463,789 | 8/1984 | Leiserson | 383/97 X |

FOREIGN PATENT DOCUMENTS

| | | | |
|---|---|---|---|
| 515968 | 1/1931 | Fed. Rep. of Germany | 114/361 |
| 867107 | 5/1961 | United Kingdom | 383/22 |

*Primary Examiner*—Joseph F. Peters, Jr.
*Assistant Examiner*—Paul E. Salmon
*Attorney, Agent, or Firm*—St. Onge Steward Johnston & Reens

[57] ABSTRACT

This invention relates to a marine power cord stowage device and more particularly to a device 10 comprising a flexible front panel 12 and a flexible back panel 14 which are joined at all but one substantilly straight edge to form opening 18, a cover 32 which is engagable to close opening 18 so that passages remain in opening 18, and a mounting structure 42 operable to removably mount device 10 on a suitable boat structure. The device of this invention allows a boat user to safely stow surplus lengths of marine power cord when in use at dock, yet does not require permanent mounting on a boat.

14 Claims, 6 Drawing Figures

FIG. 1
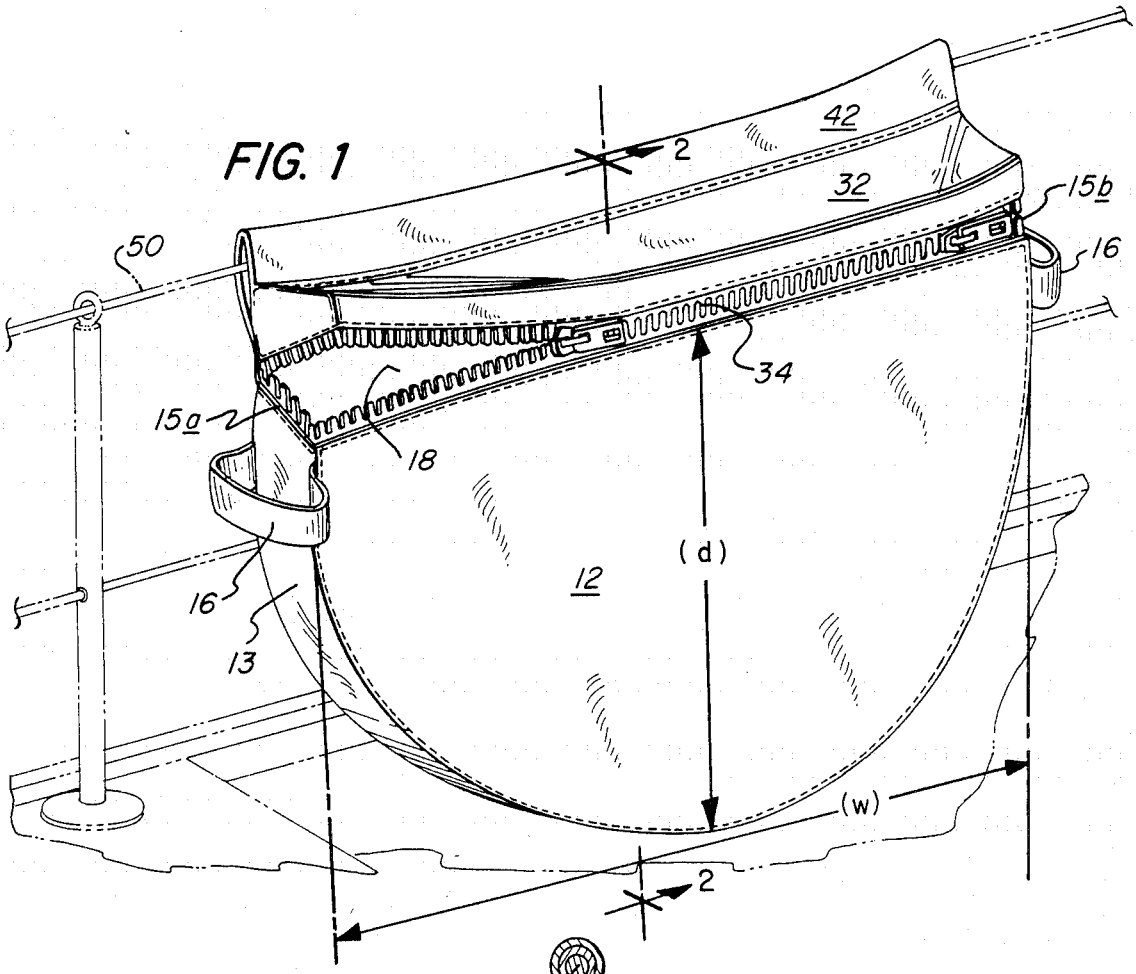
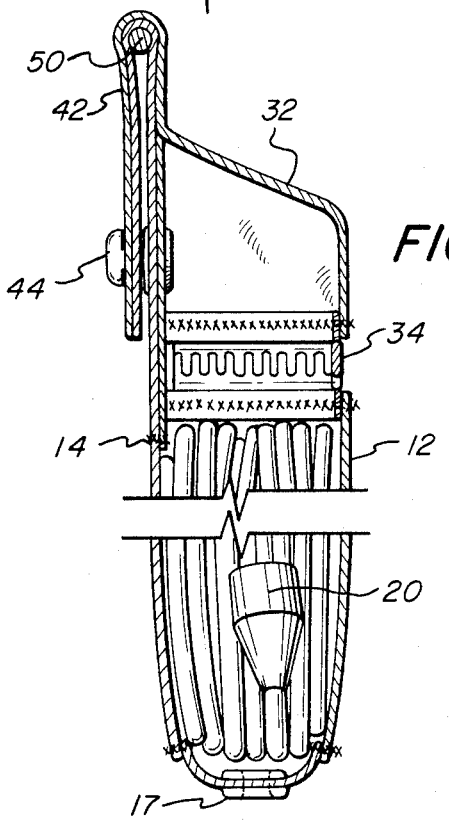
FIG. 3

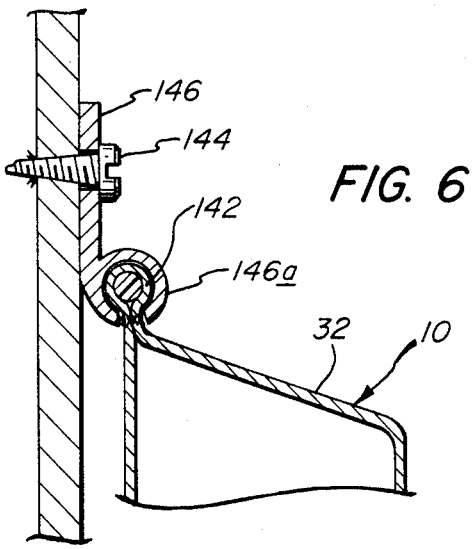
FIG. 6
FIG. 4
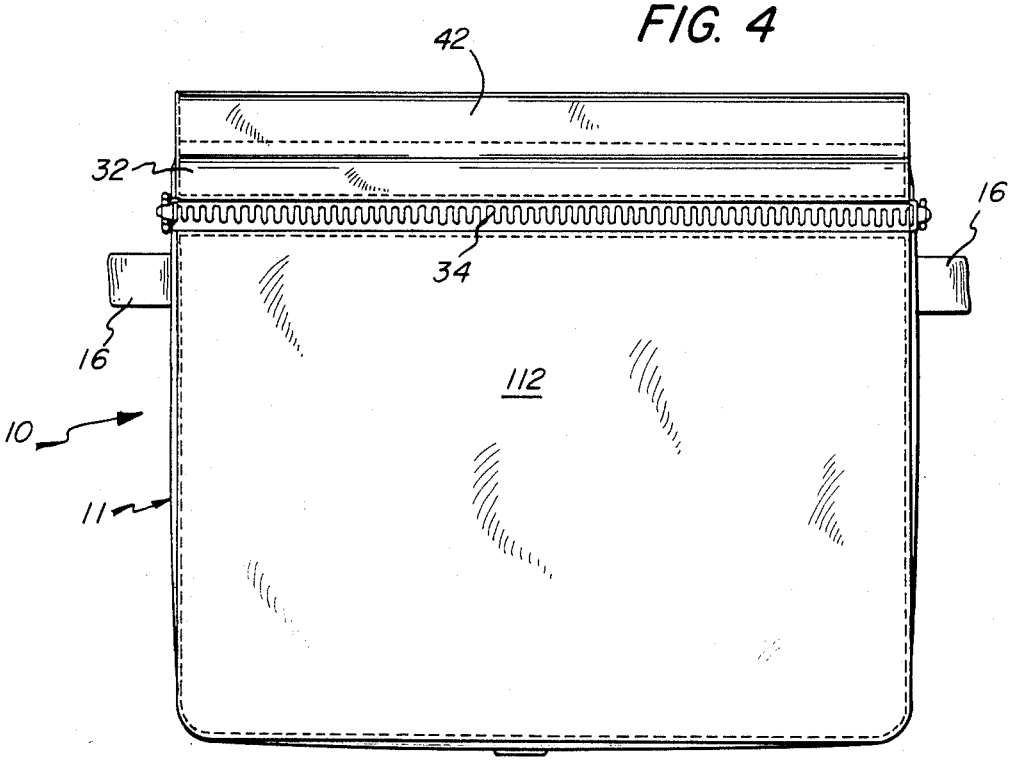

MARINE POWER CORD STOWAGE DEVICE

DESCRIPTION

1. Technical Field

This invention relates to a device for the stowage of surplus lengths of a marine power cord while the cord is in use and also for stowage of the cord when not in use.

A boat when docked requires a source of electricity other than its own batteries in order to enable operation of electrical appliances without causing the batteries to run down. This is true whether the boat is a power boat or a sailboat. Typically, this source of electricity is provided from the dock via a marine power cord. Due to the various sizes and shapes of boats and the different locations at which a boat's electrical connection is placed, the power cord is generally longer than necessary to ensure that it reaches the connection; and because of the likelihood of exposure to water, the power cord is generally constructed with a relatively thick layer of insulation to prevent the possibility of a short circuit.

Unfortunately, the length and thickness of a marine power cord often leads to tangled lengths of cord lying on the deck leading to a hazardous condition for occupants of the boat.

2. Background Art

It is known in the prior art to dispose various hooks and other brackets at various locations on the boat. The surplus lengths of power cord can then be looped around such hooks or brackets to eliminate the need to leave the cord lying on the deck. In this way, even when the boat is at sea, or in any situation where a power cord is not needed, the brackets and hooks remain and present a hazard themselves.

U.S. Pat. No. 4,037,720 to McGurk discloses a carrier for automotive battery cables which can be used to store the cables when not in use and which allows for rapid deployment of the cables when needed. The carrier disclosed is not used to store excess lengths of cable when the cable is in use, is not removably mountable, and is not collapsable when the carrier is not in use, for storage convenience. In a similar vein, U.S. Pat. No. 2,763,707 to Soderberg discloses a box for storage of excess lengths of television antenna and power wires. The box is non-collapsible and is permanently mounted on a television.

SUMMARY OF THE INVENTION

This invention relates to a marine power cord stowage device, wherein surplus lengths of a marine power cord can be stowed out of the way of occupants of a boat while the cord is in use, as well as the entire cord when not in use. The stowage device is convenient to removably mount to a boat structure such as a lifeline or a railing where the obtrusion of the device can be minimized and the ends of the cord conveniently and safely lead to, for instance, a bow located source of electric power and a stern located electrical connection.

This is achieved with a stowage device according to the present invention by joining front and back panels made of a durable, flexible material to form a receptacle into which the marine power cord fits. The upper end of the receptacle has a opening that can be closed by a cover with a connector such as a zipper that can provide opposite side located passages through which the ends of the marine power cord can pass, while a portion of the cord remains inside the receptacle. The device is also provided with a mounting means such as a flap affixed to the back panel with which the device can be mounted or suspended from a boat structure.

In another stowage device in accordance with this invention the flexible back panel is provided along an upper edge with an elongate enlargement sized to slideably fit and be retained inside an elongate slot of a boat-mountable bracket. The slot is an elongate opening through which the back panel is passed to suspend the stowage device from the bracket. With a marine power cord stowage device in accordance with this invention, marine power cords for boats can be conveniently handled on the deck of a boat and securely fastened while easily removed. It is therefore an object of the invention to provide a marine power cord stowage device which is convenient to install and used to hold a marine power cord while the power cord is in use and wherein the device is easy to remove for stowage.

These and other advantages and objects of the invention can be understood from the following description of several embodiments described in conjunction with the drawings.

BRIEF DESCRIPTION OF THE DRAWINGS

The present invention will be better understood and its advantages more apparent in view of the following detailed description, especially when read with reference to the appended drawings, wherein:

FIG. 1 is a front perspective view of the device of the present invention;

FIG. 3 is a side plan view in cross-section of the device of the present invention;

FIG. 4 is a front plan view of an alternate the embodiment of device of the present invention;

FIG. 6 is a fragmentary view in cross-section of an alternate embodiment of the device of the present invention.

DISCLOSURE OF INVENTION

The present invention relates to a device 10 for the stowage of surplus lengths of a marine power cord. More particularly, the invention relates to a device 10 which is removably mounted on a boat structure and which can be used to stow surplus lengths of a marine power cord while the cord is in use. The device 10 of this invention can also function to stow the entire marine power cord when the cord is not in use. For the convenience of description, terms such as "upward", "downward", "top", "bottom", etc., are used herein referring to the device in an orientation as illustrated in FIG. 1. It will be understood that various different orientations for the device are possible, especially when the device is used for stowage of an entire marine power cord when the cord is not in use. Device 10 of this invention may be used with power cords of the types commonly used in marine applications, especially those used to supply electrical power to a docked boat.

Figure 2:
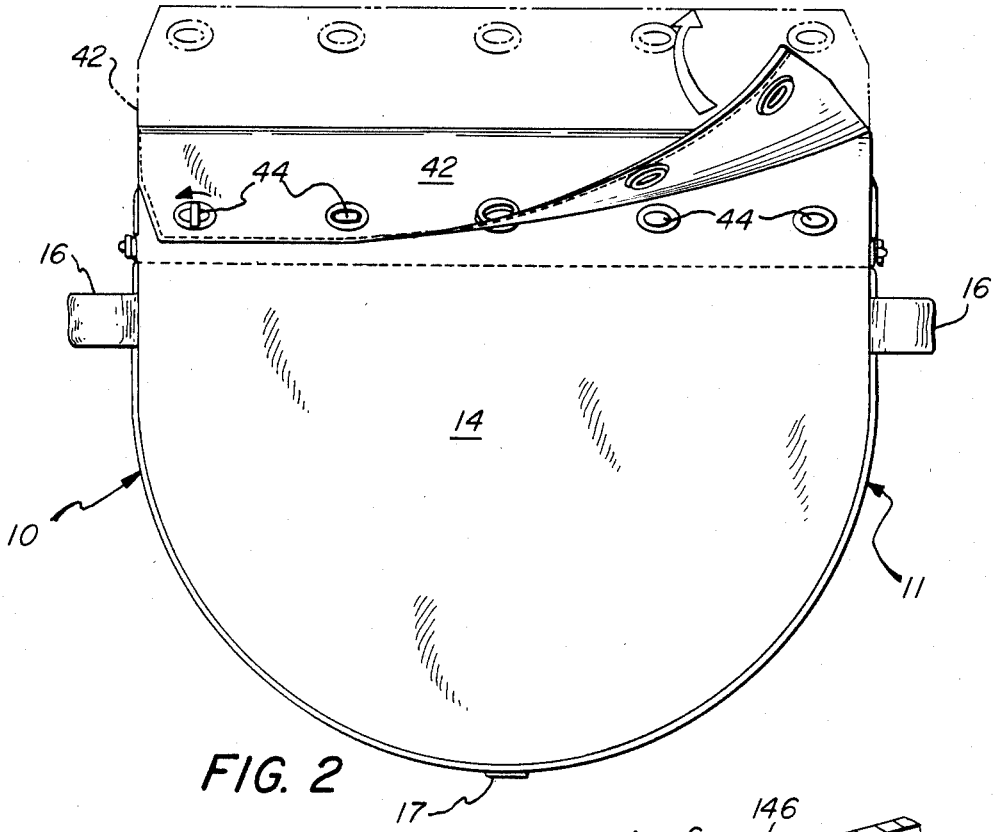
FIG. 2 is a back perspective view of the device of the present invention.

As illustrated in FIGS. 1 and 2, the marine power cord stowage device 10 of this invention is generally embodied in a receptacle 11 comprising a flexible front panel 12 and a flexible back panel 14, wherein the front and back panels 12 and 14 are joined at all but one edge to form an opening 18. Device 10 further comprises a cover affixed to back panel 14 and which is engagable to close opening 18 and adaptable to allow a plurality of passages to remain while engaged, i.e., the cover is laterally adjustable, as illustrated in FIG. 1, and a mounting means affixed to back panel 14 either directly or through cover 32 and which is operable for removably mounting device 10 on a suitable boat structure, as discussed in more detail below. Generally, device 10 is mounted so as to be suspended inside the boat due to the recognizable hazards of operating a boat with a removable structure suspended outside. When at dock, device 10 can be mounted either inside or outside the boat for convenient usage.

Referring particularly to FIGS. 1 and 3, front and back panels 12 and 14 can be joined together to form receptacle 11 by any suitable means, such as by stitching them together. Advantageously, front and back panels 12 and 14 are joined together by disposing a strip 13 between front and back panels 12 and 14 and joining the edges of front and back panels 12 and 14 respectively to the edges of strip 13, preferably by stitching.

Front and back panels 12 and 14, as well as strip 13, may be formed of any material having suitable structural stability to withstand the stress caused by the weight of marine power cord 20 when stowed in device 10. Moreover, receptacle 11 should be formed of a material which exhibits a minimum of degradation upon regular contact with water, preferably a water-proof material. Advantageously, receptacle 11 is made of a material selected from the group consisting of an acrylic material, canvas, coated canvas, vinyl, leather, plastic and nylon. More preferably, pouch 10 is vinyl, most preferably vinyl reinforced with dacron threads, such as Weblon brand yacht fabric commercially available from Weblon, Inc. of White Plains, N.Y. Most preferably, back panel 14 is, at least partially, a laminate of two plies for sufficient strength and structural stability, as illustrated in FIG. 3.

The shape of receptacle 11 is not critical to the practice of this invention and is the subject of Design patent application Ser. No. 885,012, filed July 14, 1986. Typically, receptacle 11 is formed by front and back panels 12 and 14, each of which has a substantially straight upper edge which comprise the unjoined edges, and a generally semicircular lower portion, as illustrated in FIGS. 1 and 2. Alternatively, receptacle 11 is formed to have a straight upper edge and a substantially square lower portion, as illustrated in FIG. 4. The depth (d) and width (w) of receptacle 11 can vary depending on the length and thickness of marine power cord to be stowed in device 10 and the location on the boat at which device 10 is to be mounted. Typically, receptacle 11 has a depth of about 10 to about 24 inches, preferably about 14 to about 20 inches and a width of about 20 to about 36 inches, preferably about 26 to about 30 inches. Moreover, when strip 13 is used to join back and front panels 12 and 14 together, strip 13 is preferably about 3 to about 4 inches wide to provide additional space inside receptacle 11. If substantially smaller, receptacle 11 would not be able to accommodate standard marine power cords such as 50 amp, 50 foot cords which are commonly used. If receptacle 11 is substantially larger, device 10 will not be suspended from the boat structure on which it is mounted, but will, rather, lay on the deck, thereby posing an inconvenience and a hazard in and of itself.

Referring now to FIGS. 1 and 3, device 10 further comprises a cover 32. Cover 32 can be engaged to close opening 18 formed by the unjoined edges of front and back panels 12 and 14 in such a way that a plurality of passages remain in end portions **15*a* and 15*b* while cover 32 is engaged to allow for ingress and egress of the ends of power cord 20 when in use, so the ends can engage the appropriate electrical connections. Preferably, cover 32 can also be engaged to completely close opening 18 to facilitate convenient stowage of entire marine power cord 20 either while mounted on boat structure 50 or while stowed below-deck or in any other appropriate location, as illustrated in FIG. 3. Cover 32 can be comprised of any suitable means for closing opening 18 and advantageously comprises a domed element disposed on back panel 14 which can engage front panel 12 by a connector 34. Cover 32 can be comprised of any suitable material such as described in relation to front and back panels 12 and 14, and is advantageously the same material as front and back panels 12 and 14, i.e., vinyl reinforced with dacron threads. Preferably, connector 34 is any conventional fastening means such as, for instance, a plurality of snaps, buckles, or eye and hook arrangements, a Velcro brand fastener or a zipper. Most preferably, connector 34 comprises a zipper. The preferred zipper for use in this invention is one which utilizes two zipper slides. In this way, the respective zipper slides can be disposed to slide away from the ends, 15*a* and 15*b*, of receptacle 11, thereby allowing a central portion of connector 34 to be engaged while the end portions are not engaged. By doing this, ends 15*a* and 15*b* of receptacle 11 are left open while the central portion of receptacle 11 is closed by cover 32. Advantageously, when in use connector 34 is adjusted to close as much of opening 18 as allowable to position the ends of marine power cord 20 as securely as possible. Most preferably, connector 34 is comprised of a material which is not affected by repeated contact with water, especially salt water. For instance, when a zipper is used as connector 34**, the zipper is preferably comprised of a plastic material to avoid corrosion or rust.

Advantageously, cover 32 is affixed to back panel 14 by stitching cover 32 onto back panel 14, as illustrated in FIG. 3. Alternatively, cover is formed as a single integral unit with back panel 14. Other equally applicable methods of affixing cover 32 to back panel 14 will be apparent to the skilled artisan. Preferably, cover 32 is constructed to be domed as illustrated in FIGS. 1 and 3, meaning that it has a certain lateral dimensional stability provided by sidewalls **33*a* and 33*b* (not shown) disposed on either end of cover 32 to provide more area in the internal portion of device 10 than provided if cover 32** is merely a flat piece of material.

As illustrated in FIGS. 2 and 3, the mounting means preferably comprises a flap 42 which can advantageously be affixed to back panel 14 either directly or by being disposed on cover 32 which in turn is affixed to back panel 14. Preferably, flap 42 is formed at least partially as an integral member of back panel 14, such as by continuing back panel 14 a suitable distance above opening 18. Flap 42 may also be formed by continuing cover 32 beyond the point where cover 32 is affixed to back panel 14, as illustrated in FIG. 3. In either case, flap 42 is considered to be affixed to back panel 14. Flap 42 is of sufficient length to wrap around the boat structure 50 on which device 10 is to be mounted and can engage either itself or another part of device 10 by a fastener 44 to removably mount device 10 to boat structure 50, as illustrated in FIGS. 1 and 3. Preferably, flap 42 has a length of about 8 to about 16 inches, more preferably about 11 to about 13 inches from a point on back panel 14 approximately level with opening 18. The actual length of flap 42 can vary depending upon whether flap 42 is disposed on cover 32 or affixed directly to back panel 14. Flap 42 can be comprised of any suitable material such as described in relation to front and back panels 12 and 14, and is preferably the same material as front and back panels 12 and 14, i.e., vinyl reinforced with dacron threads and is most preferably two plies of such material for sufficient strength and structrual stability, as illustrated in FIG. 3. Fastener 44 can be any conventional fastening means suitable to facilitate engagement of flap 42 with itself or with back panel 14 and is typically a fastener having a first portion thereof disposed on flap 42 and a second portion thereof disposed on either back panel 14 or another location on flap 42. Preferably, fastener 44 is comprised of materials which are not subject to corrosion or other deleterious effects upon repeated exposure to water, especially salt water, such as nickel coated on brass. Fastener 44 can be disposed on device 10 by suitable means and is most preferably riveted onto device 10 for strength. Fastener 44 advantageously comprisess a plurality of snaps or eye and hook arrangements. Most preferably, fastener 44 comprises a plurality of buckles, such as those commercially available as Common Sense brand fasteners from Dot Manufacturing Co. of Gardner, Kans., as illustrated in FIG. 2. Device 10 can be mounted on any suitable boat structure around which flap 42 can be wrapped. For instance, device 10 can be mounted on a lifeline, a stanchion post or a railing.

Figure 5:
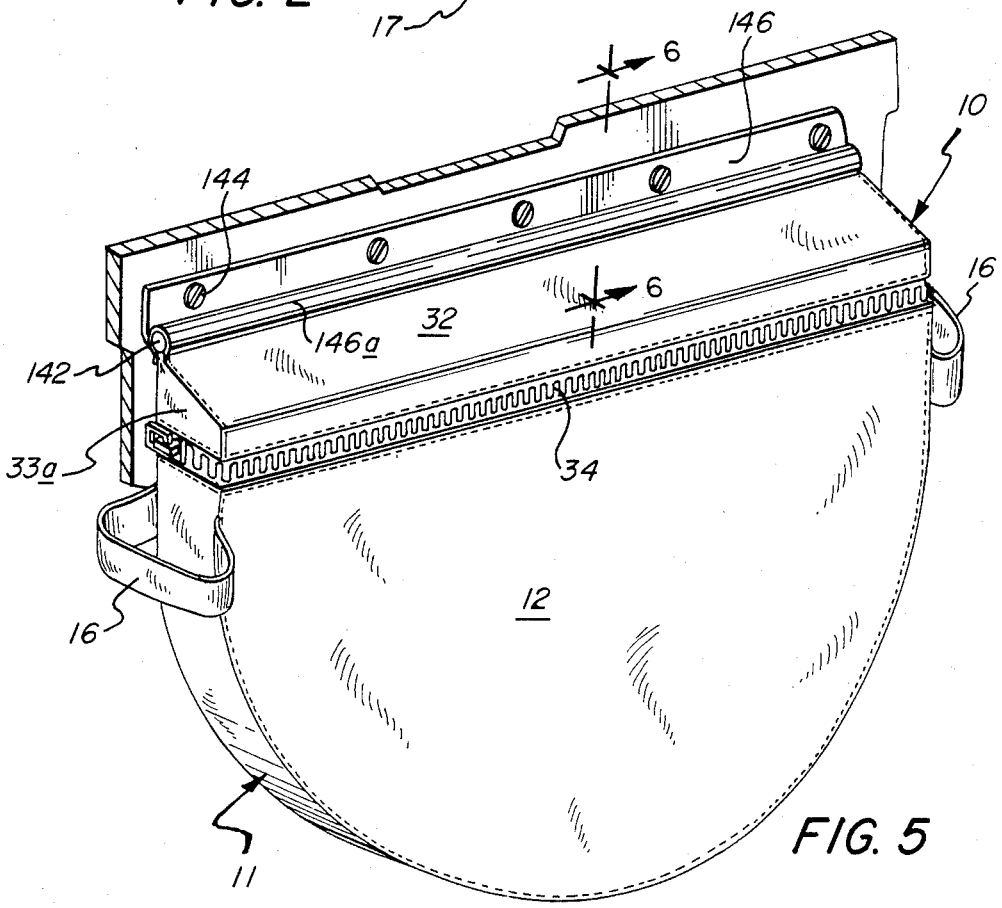
FIG. 5 is a front perspective view of an alternate embodiment of the device of the present invention.

If the structure on which it is desired to mount device 10 is not suitable for use of flap 42 as described above, an alternate embodiment of the mounting means, illustrated in FIGS. 5 and 6, may be utilized. Such alternate embodiment comprises an elongate cross-sectionally enlarged upper edge 142 disposed on cover 32 and slotted bracket 146. Elongate edge 142 is a structure either disposed on, such as by stitching onto, cover 32, or, preferably, formed integrally with cover 32. Edge 142 can advantageously be a length of cord or a plastic rod. Additionally, edge 142 can be formed from the material used to form cover 32 by folding the material back onto itself. Bracket 146 may be mounted by conventional means on a suitable wall or surface of a boat, especially on a gunwale underneath a solid rail, such as by screws 144 as illustrated in FIGS. 5 and 6, and edge 142, disposed on cover 32, can removably engage the slotted portion **146*a* of bracket 146 to mount device 10**.

Desirably, device 10 may also comprise such ancillary features as handles 16 for carrying pouch 10 and grommet 17 for drainage, as illustrated in FIGS. 1–3.

Furthermore, when marine power cord 20 is not stowed in device 10, the nature of the materials use to form device 10 allows it to be folded or otherwise collapsed to easily and conveniently stow device 10 without requiring an excessive amount of space.

While a preferred embodiment of the present invention has been described above and illustrated in the accompanying drawings, it is understood that other embodiments are within the contemplation of the inventor and his invention is not limited to the embodiments shown.

I claim:

1. A marine power cord stowage device for a boat, the device comprising a flexible front panel having an upper edge; a flexible back panel having an upper edge, said back panel effectively joined to said front panel to form a receptacle having therein a marine power cord having two ends, said receptacle having an opening between the upper edge of said front panel and the upper edge of said back panel through which the marine power cord can be inserted; a cover affixed to said back panel to close said opening, said cover being laterally adjustable to provide opposite side located passages through which the ends of the marine power cord can pass while a portion of the marine power cord remains inside said device; and mounting means effectively affixed to said back panel removably suspending said device on a boat structure.

2. The device of claim 1 wherein said cover comprises a connector and a domed element affixed to said back panel, said domed element being removably attachable to said front panel by said connector.

3. The device of claim 2 wherein said connector comprises a zipper utilizing two zipper slides to allow a central portion of said opening to be closed while passages remain open.

4. The device of claim 1 wherein said mounting means comprises a flap affixed to said back panel, and a fastener affixed to said flap and said back panel, said flap being of sufficient length to wrap around the boat structure on which said device is mounted and engage said back panel by said fastener, thereby mounting said device on the boat structure.

5. The device of claim 4 wherein said fastener comprises a plurality of buckles.

6. The device of claim 1 wherein said mounting means comprises an elongate cross-sectionally enlarged upper edge disposed on said cover, said edge being adaptable to engage a slotted bracket disposed on the boat structure, to mount said device on the structure.

7. The device of claim 1 wherein said mounting means comprises an elongate cross-sectionally enlarged upper edge disposed on said back panel, said edge being adaptable to engage a slotted bracket disposed on the boat structure, thereby mounting said device on the structure.

8. The device of claim 4 wherein said front panel, said back panel, said cover and said flap are each comprised of materials selected from the group consisting of canvas, coated canvas, vinyl, leather, plastic and nylon.

9. The device of claim 8 wherein said front panel and said back panel are each comprised of vinyl.

10. The device of claim 9 wherein said cover and said flap are each comprised of vinyl.

11. A power cord stowage device for a boat, the device comprising a flexible front panel, having upper edge; a flexible back panel having an upper edge, said back panel effectively joined to said front panel to form a receptacle having therein a marine power cord, said receptacle having an opening between the upper edge of said front panel and the upper edge of said back panel through which the marine power cord can be inserted; a domed cover affixed to said back panel and removably attachable to said front panel to close said opening by a zipper utilizing two zipper slides to close a central portion of said opening while end portions of said opening remain open; and a flap affixed to said back panel comprising a fastener and being of sufficient length to wrap around a boat structure on which said device is mounted and engage said back panel thereby removably mounting said device on the boat structure.

12. The device of claim 11 wherein said front panel, said back panel, said cover and said flap are each comprised of materials selected from the group consisting of canvas, coated canvas, vinyl, leather, plastic and nylon.

13. The device of claim 12 wherein said front panel and said back panel are each comprised of vinyl.

14. The device of claim 13 wherein said cover and said flap are each comprised of vinyl.

* * * * *